US011708797B2

(12) United States Patent
Kim et al.

(10) Patent No.: US 11,708,797 B2
(45) Date of Patent: Jul. 25, 2023

(54) VALVE SYSTEM OF VEHICLE FUEL PUMP

(71) Applicants: HYUNDAI MOTOR COMPANY, Seoul (KR); KIA MOTORS CORPORATION, Seoul (KR)

(72) Inventors: Keun Soo Kim, Yongin-si (KR); Jung Hoon Park, Suwon-si (KR); Dong Hyun Kim, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 30 days.

(21) Appl. No.: 17/103,167

(22) Filed: Nov. 24, 2020

(65) Prior Publication Data

US 2021/0293185 A1 Sep. 23, 2021

(30) Foreign Application Priority Data

Mar. 23, 2020 (KR) ..... 10-2020-0035073

(51) Int. Cl.

| | |
|---|---|
| ***F02M 37/04*** | (2006.01) |
| ***F02D 1/16*** | (2006.01) |
| ***F02D 1/06*** | (2006.01) |
| *F02D 1/00* | (2006.01) |
| *F02M 37/02* | (2006.01) |

(52) U.S. Cl.

CPC ..... *F02D 1/16* (2013.01); *F02D 1/06* (2013.01); *F02D 2001/0005* (2013.01); *F02D 2200/0602* (2013.01); *F02M 37/025* (2013.01)

(58) Field of Classification Search

CPC ..... F02M 37/025; F02M 37/106; B60K 2015/0325; F02B 1/16; F02B 1/06; F02D 2001/0005; F02D 2200/0602

See application file for complete search history.

(56) References Cited

U.S. PATENT DOCUMENTS

| | | | | |
|---|---|---|---|---|
| 6,068,022 | A * | 5/2000 | Schultz | F16K 15/025 137/538 |
| 7,717,090 | B2 * | 5/2010 | Honda | F02M 37/0058 123/511 |
| 2006/0231079 | A1 * | 10/2006 | Paluszewski | F02M 37/106 123/514 |
| 2013/0248027 | A1 * | 9/2013 | Gutscher | F02M 59/44 137/565.11 |
| 2021/0101472 | A1 * | 4/2021 | Kim | F02D 33/006 |

* cited by examiner

*Primary Examiner* — Gonzalo Laguarda

(74) *Attorney, Agent, or Firm* — Morgan, Lewis & Bockius LLP

(57) ABSTRACT

A valve system of a vehicle fuel pump includes: a reservoir cup disposed within a fuel tank storing fuel in the reservoir cup; a fuel pump configured to pump fuel from the reservoir cup to the engine while supplying fuel to a jet pump through a first discharge port; a jet pump configured to charge the reservoir cup with fuel by drawing fuel from the fuel tank by using a pressure of fuel supplied by the fuel pump; and a jet pump control valve disposed on the first discharge port and configured to control a flow of fuel discharged from the fuel pump to the jet pump.

9 Claims, 8 Drawing Sheets

FIG. 1 - PRIOR ART -

FIG. 2 - PRIOR ART -

FIG. 3 - PRIOR ART -

In Start: Before Reaching 1st Set Pressure
→ Only Engine Flow Path is Opened

In Start: After Reaching 1st Set Pressure →
Both Engine Flow Path and Jet Pump Path are Opened In Stopping: In Reaching 2nd Set Pressure
→ Jet Pump Path is Closed

VALVE SYSTEM OF VEHICLE FUEL PUMP

CROSS REFERENCE TO RELATED APPLICATION

The present application claims the benefit of priority to Korean Patent Application No. 10-2020-0035073, filed on Mar. 23, 2020 in the Korean Intellectual Property Office, the entire contents of which is incorporated herein for all purposes by this reference.

TECHNICAL FIELD

The present disclosure relates generally to a valve system of a vehicle fuel pump, and more particularly, a valve system of a vehicle fuel pump, the valve system being able to reduce an engine start time to improve cold startability.

BACKGROUND

Generally, a fuel supply system of a vehicle is a system for properly supplying an engine with required fuel in any driving conditions. The fuel supply system is one of major factors determining the output power and performance of the engine.

Recently, a jet pump system enabling a reservoir cup or the like of the fuel tank to be properly filled with fuel in a condition, in which the engine consumes a maximum flow rate of fuel, is used in order to increase the output power of the engine and improve the performance of the engine in a variety of driving conditions.

In the accompanying drawings, FIG. 1 is a conceptual view illustrating a fuel supply system according to an example of the related art.

Referring to FIG. 1, the fuel supply system of the related art includes: a unitary fuel tank 10 storing fuel therein; a reservoir cup 11 disposed on the bottom within the fuel tank 10 to be continuously charged with fuel from the fuel tank 10; a fuel pump 13 pumping fuel from the reservoir cup 11 to the engine and discharging a portion of fuel to a jet pump 12; a fuel filter 14 disposed within the reservoir cup 11 to filter fuel supplied to the engine; the jet pump 12 disposed on the bottom of the reservoir cup 11 charging the reservoir cup 11 with fuel by drawing fuel from the fuel tank 10; and the like.

In the fuel supply system of the related art, when fuel is pumped from the fuel pump 13 to the engine due to driving of the fuel pump 13, a portion of fuel is discharged toward the jet pump 12.

In addition, when fuel discharged toward the jet pump 12 passes through the jet pump 12, instantaneous vacuum suction force is generated within the jet pump 12.

Thus, due to the instantaneous vacuum suction force of the jet pump 12, fuel is drawn from the fuel tank 10 into the reservoir cup 11 so that the reservoir cup 11 is charged with fuel.

In the accompanying drawings, FIG. 2 is a conceptual view illustrating a fuel supply system according to another example of the related art.

Referring to FIG. 2, the fuel supply system of the related art includes: a saddle-shaped fuel tank 10 comprised of a first fuel storage space 10-1 and a second fuel storage space 10-2 separated from the first fuel storage space 10-1; a reservoir cup 11 disposed on the bottom of the first fuel storage space 10-1 to be continuously charged with fuel from the fuel tank 10; a fuel pump 13 pumping fuel from the reservoir cup 11 to the engine and discharging a portion of fuel to first and second jet pumps 12-1 and 12-2; a fuel filter 14 disposed within the reservoir cup 11 to filter fuel supplied to the engine; the first jet pump 12-1 disposed on the bottom of the reservoir cup 11 to charge the reservoir cup 11 with fuel by drawing fuel from the first fuel storage space 10-1; the second jet pump 12-2 mounted on an inner portion of the reservoir cup 11 to charge the reservoir cup 11 with fuel by drawing fuel from the second fuel storage space 10-2; and the like.

The fuel tank of the fuel supply system may be a unitary fuel tank, as illustrated in FIG. 1, or a saddle-shaped fuel tank, as illustrated in FIG. 2, depending on the vehicle type.

In the fuel supply system including the saddle-shaped fuel tank, the second jet pump 12-2 for drawing fuel from the second fuel storage space 10-2 into the reservoir cup 11 by vacuum suction is mounted within the reservoir cup 11, in addition to the first jet pump 12-1, as illustrated in FIG. 2.

In the fuel supply system of the related art, when fuel is pumped to the engine in response to the operation of the fuel pump 13, a portion of fuel is discharged toward the first and second jet pumps 12-1 and 12-2.

Referring to the internal configuration of each of the first and second jet pumps 12-1 and 12-2, a jet nozzle 12-3 and a discharge pipe 12-4, through which fuel discharged from the fuel pump 13 flows, are provided on one side, as illustrated in FIG. 2. On the other side, a fuel inlet port 12-5 connected to the second fuel storage space 10-2 of the fuel tank 10 in a communicating manner and a fuel suction passage 12-6 extending to the discharge pipe 12-4 in a communicating manner are provided.

Accordingly, while fuel is being pumped from the fuel pump 13 to the engine, when a portion of fuel is rapidly sprayed through the jet nozzles 12-3 in the first and second jet pumps 12-1 and 12-2 to recharge the reservoir cup 11 through the discharge pipes 12-4, vacuum suction force based on the principle of a jet pump is applied to the fuel suction passages 12-6 and the fuel inlet ports 12-5.

Subsequently, due to vacuum suction force applied to the fuel suction passages 12-6 and the fuel inlet ports 12-5, fuel is drawn from the first fuel storage space 10-1 and the second fuel storage space 10-2 of the fuel tank 10 through the fuel suction passages 12-6 and the fuel inlet ports 12-5, flows through the discharge pipe 12-4, and then is supplied into the reservoir cup 11 so that the reservoir cup 11 is filled with the fuel.

As described above, in the saddle-shaped fuel tank, the reservoir cup 11 may be easily filled with fuel supplied from the first fuel storage space 10-1 of the fuel tank 10 due to vacuum suction pumping of the first jet pump 12-1. In addition, the reservoir cup 11 may be easily filled with fuel supplied from the second fuel storage space 10-2 of the fuel tank 10 due to vacuum suction pumping of the second jet pump 12-2.

However, in the fuel supply system in which the saddle-shaped fuel tank is used, the second jet pump 12-2 used in addition to the first jet pump 12-1 may delay a time in which the pressure of fuel supplied to the engine is increased in a cold start of the engine.

In other words, when fuel is pumped to the engine by the fuel pump in the cold start of the engine, a portion of fuel discharged to the first and second jet pumps may cause a loss in the flow rate to increase a time in which the pressure of fuel supplied to the engine by the fuel pump reaches a set pressure for the start of the engine, thereby causing a delay in the cold start of the engine.

For example, although a time in which the pressure of fuel supplied to the engine by the fuel pump is increased to a set pressure in the cold start of the engine may be required to be about 250 ms or less, an actual time in which the pressure of fuel is increased to the set pressure is 1 second or more, as illustrated in FIG. 3. Accordingly, this may degrade cold startability of the engine, which is problematic.

The foregoing is intended merely to aid in the understanding of the background of the present disclosure, and is not intended to mean that the present disclosure falls within the purview of the related art that is already known to those skilled in the art.

SUMMARY

The present disclosure has been made keeping in mind the above problems occurring in the related art, and the present disclosure is intended to propose a valve system of a vehicle fuel pump, the valve system being able to reduce a time in which the pressure of fuel supplied to the engine by a fuel pump is increased to a set pressure in a cold start of the engine and to ensure a jet pump is operable any time after the start of the engine.

In order to achieve the above objective, according to one aspect of the present disclosure, there is provided a valve system of a vehicle fuel pump, the valve system including: a reservoir cup disposed within a fuel tank storing fuel therein; a fuel pump configured to pump fuel from the reservoir cup to the engine while supplying fuel to a jet pump through a first discharge port; a jet pump configured to charge the reservoir cup with fuel by drawing fuel from the fuel tank by using a pressure of fuel supplied by the fuel pump; and a jet pump control valve disposed on the first discharge port to control a flow of fuel discharged from the fuel pump to the jet pump.

The jet pump control valve may open a jet pump flow path connecting the jet pump and the first discharge port of the fuel pump when the engine is started and a pressure of fuel discharged from the fuel pump to the engine is increased to reach a first set pressure and may close the jet pump flow path when the engine is stopped and the pressure of fuel discharged from the fuel pump to the jet pump is reduced to reach a second set pressure determined to be smaller than the first set pressure.

The jet pump control valve may include: a first valve housing, with a plunger lift path having a predetermined height being provided within the first valve housing, wherein the jet pump flow path is connected to a middle position of the plunger lift path; a plunger mounted on the plunger lift path in a liftable manner so as to open and close the jet pump flow path depending on a position on the plunger lift path; a second valve housing, with a piston lift path having a predetermined height being provided within the second valve housing, and an open hole being provided on a first sidewall portion of the second valve housing; a piston mounted on the piston lift path in a liftable manner and integrally connected to the plunger via a lift bar; an elastic member disposed between a bottom surface of a top end of the second valve housing and a top surface of the piston to be compressed when the plunger moves upwards; and a foldable leaf spring mounted on the top surface of the piston and disposed between the piston and the elastic member, such that the plunger is moved upwards to open the jet pump flow path due to a pressure of fuel smaller than the first set pressure.

The foldable leaf spring may include: a horizontal leaf spring portion disposed in the piston lift path to extend in a direction perpendicular to a direction in which the piston is lifted up and down, with the elastic member being disposed on a top surface of the horizontal leaf spring portion; a vertical leaf spring portion attached to a first end of the horizontal leaf spring portion and disposed in the piston lift path in the direction in which the piston is lifted up and down, with a bottom end of the vertical leaf spring portion being fixedly mounted on the top surface of the piston; and a folding leaf spring portion integrally provided on a second end portion of the horizontal leaf spring portion in a foldable manner and disposed in the piston lift path 222 to extend in the direction in which the piston is lifted up and down, with a flange being integrally provided on a bottom end of the folding leaf spring portion to be inserted into and held by the open hole.

When the folding leaf spring portion pivots toward a bottom surface of the vertical leaf spring portion about a second end portion of the horizontal leaf spring portion due to a pressure of fuel applied to the plunger by the fuel pump, the plunger may be released and detached from the open hole and be allowed to move upwards in the plunger lift path in a direction of opening the jet pump flow path.

The foldable leaf spring may further include an inner spring disposed between the vertical leaf spring portion and the folding leaf spring portion, the inner spring being configured to be compressed when the folding leaf spring portion pivots toward the bottom surface of the vertical leaf spring portion.

The first set pressure may be a value obtained by adding a pressure of fuel for compressive deformation of the elastic member and a pressure of fuel for folding deformation of the foldable leaf spring.

The plunger lift path may include an upper lift path in which the plunger is located to open the jet pump flow path and a lower lift path in which the plunger is located to close the jet pump flow path.

When the pressure of fuel discharged to the jet pump at start of the engine is equal to or greater than the first set pressure, the jet pump control valve may cause the flange of the foldable leaf spring to be detached and released from the open hole and the plunger to be located in the upper lift path so that the jet pump flow path is opened.

When the pressure of fuel discharged to the jet pump at start of the engine is smaller than the first set pressure, the jet pump control valve may cause the flange of the foldable leaf spring to be located in and held by the open hole and the plunger to be located in the lower lift path so that the jet pump flow path remains in a closed position.

In addition, when the pressure of fuel discharged to the jet pump is reduced to be smaller than the first set pressure but is greater than the second set pressure after the jet pump path is opened, the jet pump control valve may cause the flange of the foldable leaf spring to remain released from the open hole and the plunger to remain in the upper lift path so that the jet pump flow path remains in an opened position.

According to the embodiments of the present disclosure, the valve system of a vehicle fuel pump has a structure by which a loss in the flow rate of fuel, flowing toward the jet pump, may be prevented to reduce a time in which the pressure of fuel of the engine is increased, thereby improving cold startability of the engine and ensuring the operability of the jet pump is properly maintained after the start of the engine.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION

Hereinafter, exemplary embodiments of the present disclosure will be described with reference to the accompanying drawings.

Figure 1:
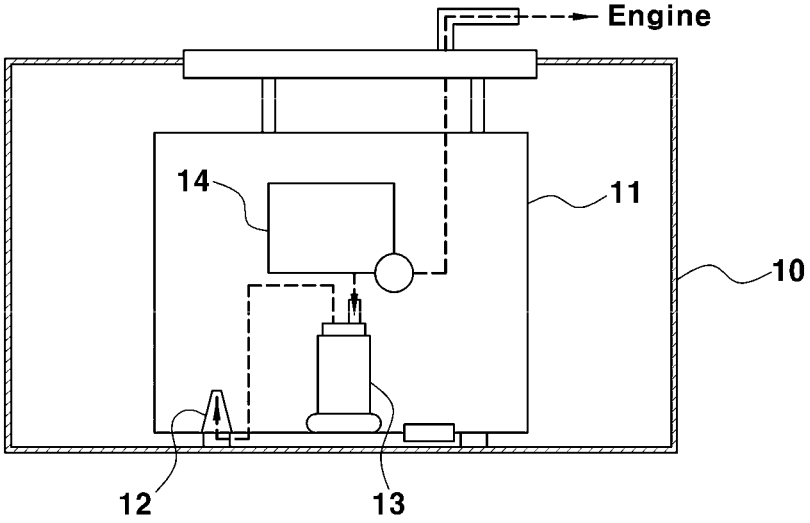
FIG. 1 is a conceptual view illustrating a fuel supply system according to an example of the related art.
Figure 2:
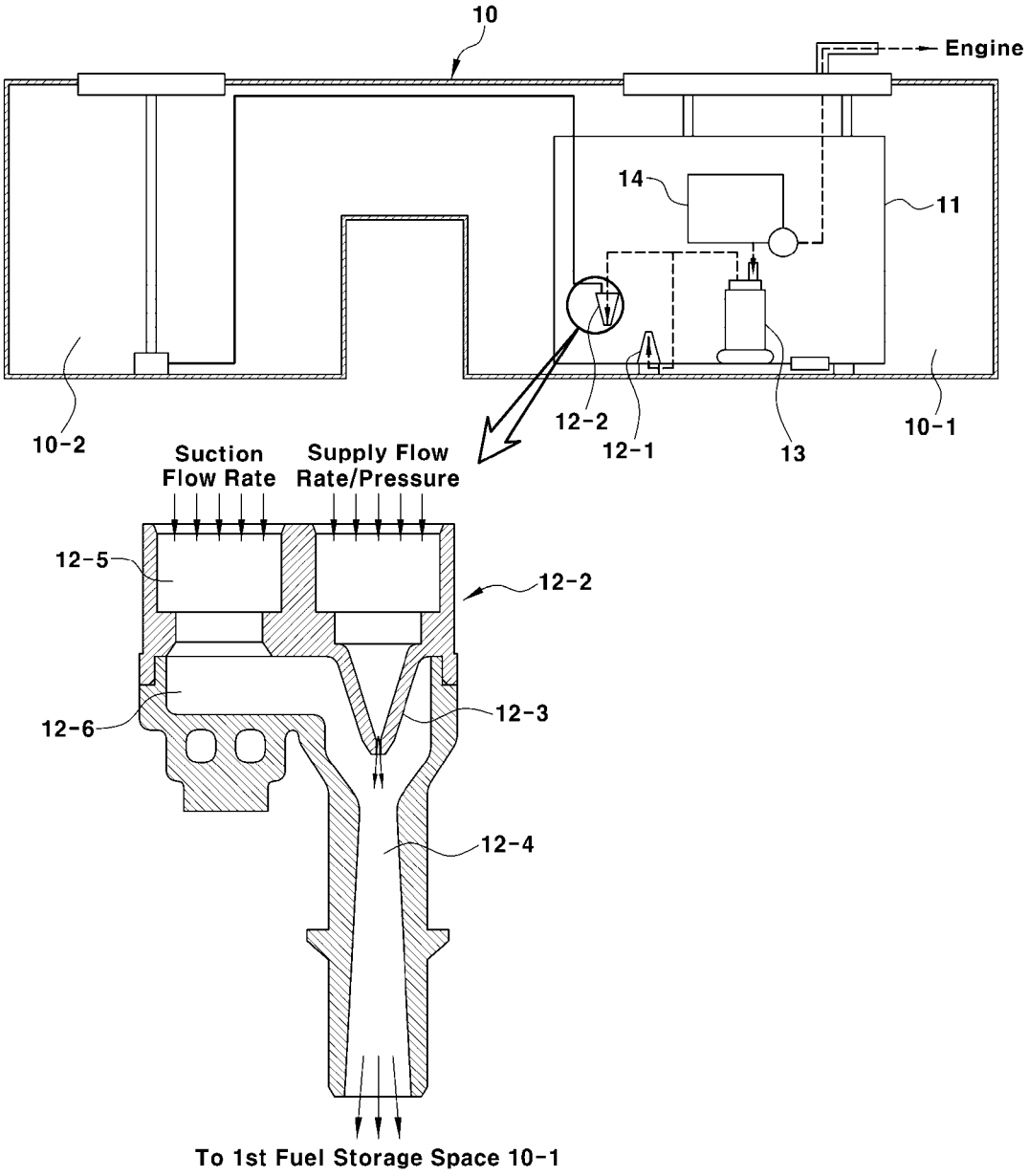
FIG. 2 is a conceptual view illustrating a fuel supply system according to another example of the related art.
Figure 3:
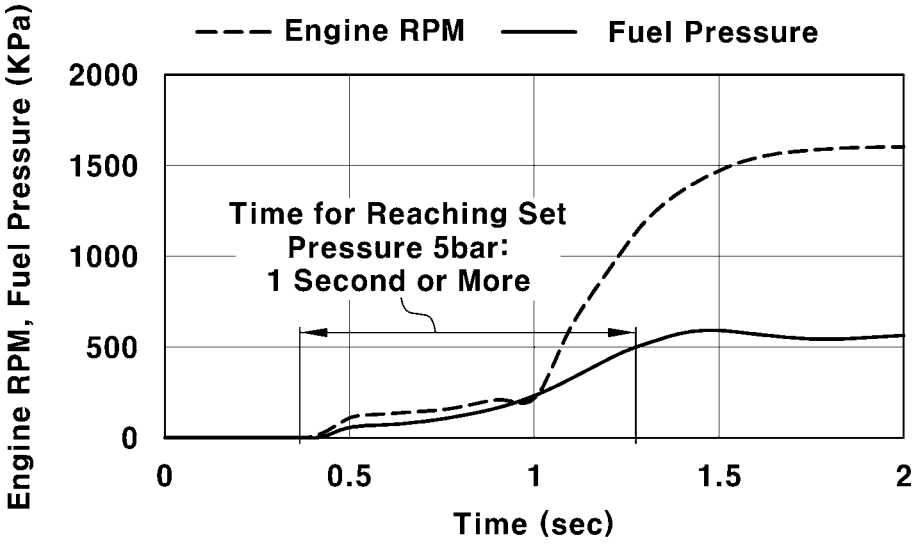
FIG. 3 is a graph illustrating cold startability of an engine in relation to the fuel supply system of the related art.
Figure 4:
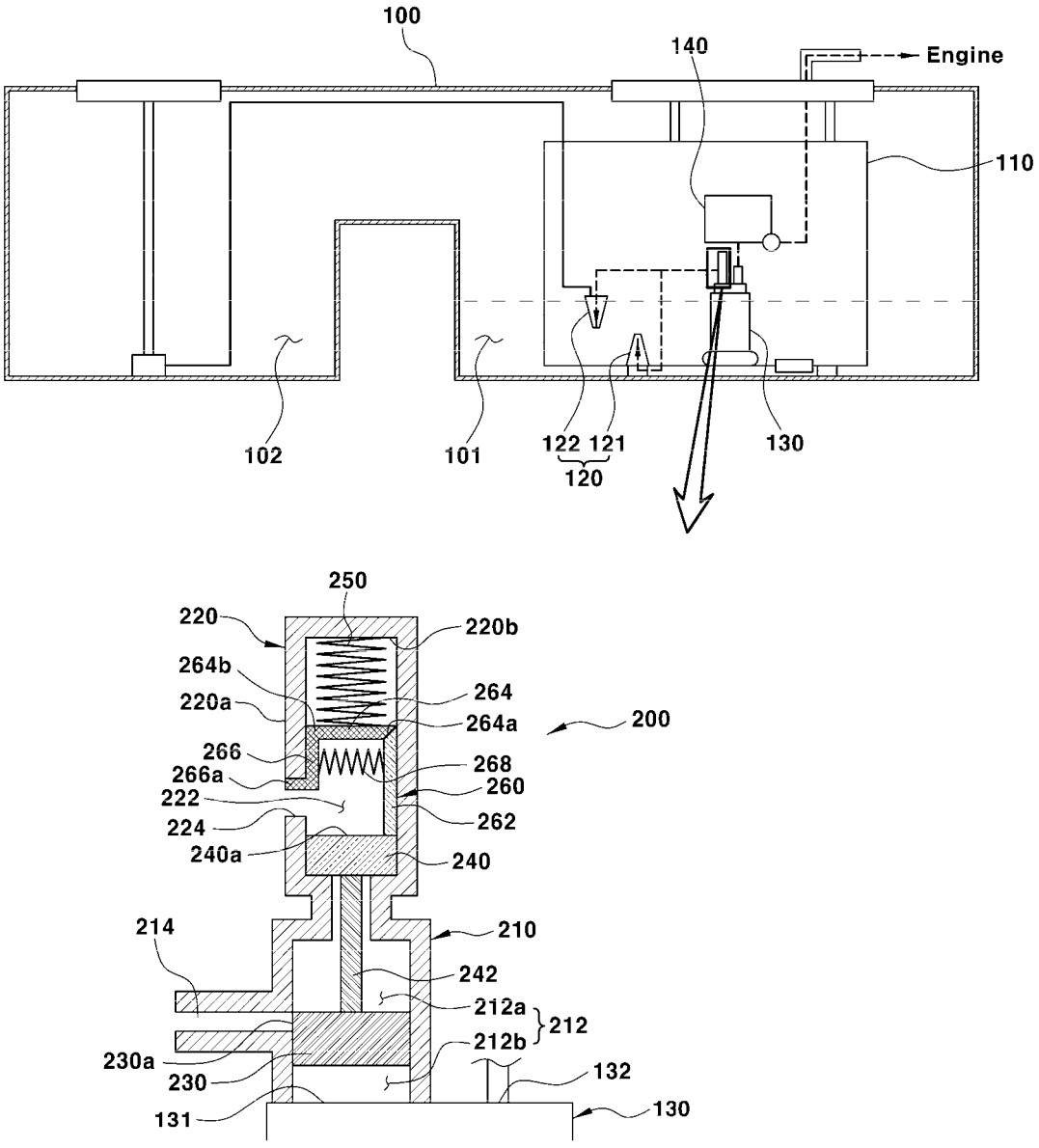
FIG. 4 is a configuration view illustrating a valve system of a fuel pump according to an embodiment of the present disclosure.

In the accompanying drawings, FIG. 4 illustrates a vehicle fuel supply system in which a valve system of a fuel pump according to an embodiment of the present disclosure is used.

As illustrated in FIG. 4, the vehicle fuel supply system may include: a fuel tank 100 storing fuel therein; a reservoir cup 110 disposed on the bottom within the fuel tank 100 to be continuously charged with fuel from the fuel tank 100; a fuel pump 130 pumping fuel from the reservoir cup 110 to the engine while supplying fuel to a jet pump 120; a fuel filter 140 disposed within the reservoir cup 110 to filter fuel supplied to the engine; and the like.

The fuel tank 100 may be a saddle-shaped fuel tank in which a first fuel storage space 101 and a second fuel storage space 102 for storing fuel are separated from each other.

In a case in which the fuel supply system includes the saddle-shaped fuel tank, the reservoir cup 110 is disposed on the bottom of the first fuel storage space 101, as illustrated in FIG. 4, so as to be continuously supplied and charged with fuel from the first fuel storage space 101. In addition, a first jet pump 121 is disposed on the bottom of the reservoir cup 110 to charge the reservoir cup 110 with fuel by drawing fuel from the first fuel storage space 101, and a second jet pump 122 is mounted on an inner portion of the reservoir cup 110 to charge the reservoir cup 110 with fuel from the second fuel storage space 102 by drawing fuel from the second fuel storage space 102.

In the fuel supply system, when fuel discharged from the fuel pump 130 is pumped to the engine in response to the fuel pump 130 being driven to drive the engine, fuel is discharged toward the first jet pump 121 and the second jet pump 122. As fuel discharged from the fuel pump 130 is supplied to the jet pump 120, fuel may easily flow from the first fuel storage space 101 of the fuel tank 100 into the reservoir cup 110 in response to vacuum suction pumping of the first jet pump 121, and fuel may easily flow from the second fuel storage space 102 of the fuel tank 100 into the reservoir cup 110 in response to vacuum suction pumping of the second jet pump 122.

The fuel pump 130 is provided with a first discharge port 131 for discharging fuel from the reservoir cup 110 toward the jet pump 120 and a second discharge port 132 for discharging fuel from the reservoir cup 110 toward the engine. When the fuel pump 130 pumps fuel from the reservoir cup 110 to the engine through the second discharge port 132, the fuel pump 130 also supplies fuel to the jet pump 120 through the first discharge port 131.

The first jet pump 121 and the second jet pump 122 may charge the reservoir cup 110 with fuel by drawing fuel from the fuel tank 100, due to the pressure of fuel supplied through the second discharge port 132 by the fuel pump 130.

According to the present disclosure, a jet pump control valve 200 is mounted on the first discharge port 131 of the fuel pump 130.

The jet pump control valve 200 is configured to be able to control a flow of fuel discharged from the fuel pump 130 toward the jet pump 120 by opening and closing a jet pump flow path 214 connecting the jet pump 120 and the first discharge port 131 of the fuel pump 130.

The jet pump control valve 200 may operate in an open mode or a closed mode, depending on the pressure of fuel discharged by the fuel pump 130 through the first discharge port 131.

As illustrated in FIG. 4, the jet pump control valve 200 is configured to open and close the jet pump flow path 214. When the engine is started and the pressure of fuel discharged from the fuel pump 130 to the jet pump 120 is increased to reach a first set pressure, the jet pump control valve 200 opens the jet pump flow path 214. When the engine is stopped and the pressure of fuel discharged from the fuel pump 130 to the jet pump 120 is reduced to reach a second set pressure, the jet pump control valve 200 closes the jet pump flow path 214.

That is, the jet pump control valve 200 is configured to maintain the jet pump flow path 214 in the closed position before the pressure of fuel supplied by the fuel pump 130 to the engine and the jet pump 120 reaches the first set pressure.

In the operation of the fuel pump 130, only when the pressure of fuel supplied by the fuel pump 130 to the engine reaches a set pressure, the start (in particular, cold start) of the engine may be facilitated.

The first set pressure is determined to be a fuel pressure value in the start of the engine in order to facilitate the start of the engine. For example, the first set pressure may be set to be in the range of from 4.0 to 5.0 bars.

The second set pressure is determined as a fuel pressure value at which the jet pump control valve 200 is converted from the open mode to the closed mode. That is, the second set pressure is a fuel pressure value determined to close the jet pump control valve 200 after the start of the engine. The second set pressure is determined as a value smaller than the first set pressure. Specifically, the set pressure may be set to be a pressure value smaller than 2.5 bars.

In addition, the jet pump flow path 214 is a flow path connecting the inlet port of the jet pump 120 and the first discharge port 131 of the fuel pump 130.

The jet pump control valve 200 includes a first valve housing 210 and a second valve housing 220 as a skeletal body to perform opening/closing operations in the above-described conditions. A plunger lift path 212 having a predetermined height is provided within the first valve housing 210, while a piston lift path 222 having a predetermined height is provided within the second valve housing 220.

The first valve housing 210 has the jet pump flow path 214 connected to a middle position of the plunger lift path 212, and the bottom of the first valve housing 210 communicates with the first discharge port 131 of the fuel pump 130.

The jet pump flow path 214 extends from the outer portion of the first valve housing 210 and is connected to the plunger lift path 212 via one end.

The plunger 230 is mounted on the plunger lift path 212 such that the plunger 230 may be lifted up and down so as to open and close the jet pump flow path 214.

The plunger 230 is configured to open and close the jet pump flow path 214, depending on the position of the plunger lift path 212. In this regard, the plunger 230 is disposed in the plunger lift path 212 to divide the plunger lift path 212 into two sections, i.e. the upper lift path 212*a* and the lower lift path 212*b*.

The plunger 230 moves toward the upper lift path 212*a* when sliding upwards to open the jet pump flow path 214. When positioned in the upper lift path 212*a*, the plunger 230 opens the jet pump flow path 214. In addition, the plunger 230 moves toward the lower lift path 212*b* when sliding downwards to close the jet pump flow path 214. When positioned in the lower lift path 212*b*, the plunger 230 closes the jet pump flow path 214.

That is, the plunger 230 is located in the upper lift path 212*a* when opening the jet pump flow path 214. The plunger 230 is located in the lower lift path 212*b* when closing the jet pump flow path 214.

In other words, the plunger 230 has a first side portion 230*a* disposed within the plunger lift path 212, at the side of the jet pump flow path 214. The first side portion 230*a* closes or opens the jet pump flow path 214, depending on the moving position.

The second valve housing 220 is disposed above the first valve housing 210, and the piston lift path 222 provided within the second valve housing 220 may communicate with the plunger lift path 212 of the first valve housing 210.

The piston 240 is mounted on the piston lift path 222 such that the piston 240 may be lifted up and down.

The piston 240 is configured such that the piston 240 may slide up and down along the inner wall surface of the second valve housing 220 in the piston lift path 222. The piston 240 is connected to the plunger 230, located in the plunger lift path 212, via a lift bar 242 such that the piston 240 moves integrally with the plunger 230.

When the piston 240 is located on the lowermost portion of the piston lift path 222, the plunger 230 is located on the uppermost portion of the lower lift path 212*b* to close the jet pump flow path 214.

That is, when the piston 240 touches the bottom surface of the second valve housing 220, the plunger 230 is located on the highest position of an area, in which the jet pump flow path 214 may be closed, in the plunger lift path 212.

In other words, when the plunger 230 moves downwards due to the pressure of fuel discharged from the first discharge port 131 of the fuel pump 130 being equal to or lower than the second set pressure, the bottom surface of the second valve housing 220 may limit a distance by which the piston 240 moves downwards, thereby allowing the plunger 230 to reliably close the jet pump flow path 214 and preventing the plunger 230 from further moving downwards and opening the jet pump flow path 214.

In addition, an elastic member 250 and a foldable leaf spring 260 are mounted on the piston lift path 222, between the bottom surface 220*b* of the top end of the second valve housing 220 and the top surface 240*a* of the piston 240.

The elastic member 250 may be elastically compressed by the pressure of fuel supplied to the bottom of the plunger 230 by the fuel pump 130. The elastic member 250 is disposed in the piston lift path 222 such that the elastic member 250 maybe compressed or restored in a lifting direction of the piston 240, i.e. a direction in which the piston 240 is lifted up and down.

Specifically, the elastic member 250 is mounted between the bottom surface 220*b* of the top end of the second valve housing 220 and the top end of the foldable leaf spring 260, such that the elastic member 250 is compressed during upward movement of the piston 240 and is restored during downward movement of the piston 240.

In addition, the foldable leaf spring 260 is mounted on the top surface of the piston 240, between the piston 240 and the elastic member 250. The foldable leaf spring 260 is configured to restrain the jet pump flow path 214 from being opened by a pressure of fuel smaller than the first set pressure.

In other words, in a case in which the pressure of fuel applied to the plunger 230 is smaller than the first set pressure while being greater than the second set pressure, the foldable leaf spring 260 restrains the plunger 230 from moving upwards in the plunger lift path 212 and opening the jet pump flow path 214.

In this regard, the foldable leaf spring 260 includes a vertical leaf spring portion 262, a horizontal leaf spring portion 264, and a folding leaf spring portion 266, each of which is implemented as an elastic leaf spring member.

The vertical leaf spring portion 262 is disposed in the piston lift path 222 to extend in the lifting direction of the piston 240, and is disposed below the elastic member 250 with the bottom end of the vertical leaf spring portion 262 being fixedly mounted on the top surface 240*a* of the piston 240.

The top end of the vertical leaf spring portion 262 is fixedly attached to a first end portion 264*a* of the horizontal leaf spring portion 264.

The horizontal leaf spring portion 264 is disposed in the piston lift path 222 to extend in a direction (i.e. a horizontal direction) perpendicular to the lifting direction of the piston 240, and the elastic member 250 is disposed on the top surface of the horizontal leaf spring portion 264.

In addition, the folding leaf spring portion 266 is disposed in the piston lift path 222 to extend in the lifting direction of the piston 240, and is integrally provided on a second end portion 264*b* of the horizontal leaf spring portion 264 in a foldable manner.

In other words, the folding leaf spring portion 266 integrally extends from the second end portion 264*b* of the horizontal leaf spring portion 264 to be disposed perpendicularly to the horizontal leaf spring portion 264.

When the plunger 230 is moved upwards, the folding leaf spring portion 266 allows the jet pump flow path 214 to be opened while being folded toward the horizontal leaf spring portion 264. Here, the top end of the folding leaf spring portion 266 integrally connected to the second end portion 264*b* of the horizontal leaf spring portion 264 may be a bent portion of the foldable leaf spring 260.

In other words, when the pressure of fuel applied to the plunger 230 reaches the first set pressure, the folding leaf spring portion 266 is folded by pivoting toward the bottom surface of the horizontal leaf spring portion 264 about the second end portion 264*b* of the horizontal leaf spring portion 264 serving as a hinge point.

The folding leaf spring portion 266 has a flange 266*a* integrally provided on the bottom end thereof. The flange 266*a* is inserted into and held by an open hole 224 of the second valve housing 220. The open hole 224 is provided on a first sidewall portion 220*a* of the second valve housing 220 to be disposed on a middle position between the first sidewall portion 220*a* and the piston lift path 222.

While the flange 266*a* is illustrated as being disposed perpendicularly to the folding leaf spring portion 266 in FIG.

4, the flange 266*a* may be disposed at an obtuse angle with respect to the folding leaf spring portion 266 when the shape of the open hole 224 is changed.

The flange 266*a* is provided to extend from the bottom end of the folding leaf spring portion 266 in a direction opposite to the vertical leaf spring portion 262. The flange 266*a* remains held by the open hole 224 before the pressure of fuel applied to the plunger 230 reaches the first set pressure.

When the folding leaf spring portion 266 is folded by pivoting toward the bottom surface of the horizontal leaf spring portion 264 about the second end portion 264*b* of the horizontal leaf spring portion 264, the flange 266*a* is released from the open hole 224.

When the flange 266*a* is detached and released from the open hole 224, the foldable leaf spring 260 allows the plunger 230 to move upwards.

The foldable leaf spring 260 having the above-described configuration restrains the upward movement of the plunger 230 for opening the jet pump flow path 214 when the pressure of fuel applied to the bottom surface of the plunger 230 is smaller than a sum (i.e. third fuel pressure) obtaining by adding the first fuel pressure and the pressure of fuel (i.e. second fuel pressure) for the folding of the foldable leaf spring 260, even in a case where the pressure of fuel applied to the bottom surface of the plunger 230 is greater than the pressure of fuel (i.e. first fuel pressure) for compressive deformation of the elastic member 250.

The third fuel pressure is a value obtained by adding the first fuel pressure for compressive deformation of the elastic member 250 and the second fuel pressure for folding deformation of the foldable leaf spring 260. The third fuel pressure is set as a minimum pressure value of fuel applied to the plunger 230 by the fuel pump 130 for the opening operation of the jet pump control valve 200.

The third fuel pressure may be determined to be a value equal to or greater than an engine start reference fuel pressure (i.e. the first set pressure) supplied to the engine by the fuel pump 130.

For example, the minimum fuel pressure value applied to the plunger 230 by the fuel pump 130 for the opening operation of the jet pump control valve 200 may be set to be in the range of 4.5±0.5 bars. The maximum fuel pressure value for the closing operation of the jet pump control valve 200 may be set to be in the range of 2.0±0.5 bars.

In addition, the foldable leaf spring 260 may further include an inner spring 268 disposed between the vertical leaf spring portion 262 and the folding leaf spring portion 266.

The inner spring 268 is configured to press the folding leaf spring portion 266 in the piston lift path 222 toward the first sidewall portion 220*a* of the second valve housing 220. The inner spring 268 is elastically compressed when the folding leaf spring portion 266 is folded toward the horizontal leaf spring portion 264.

In addition, when the plunger 230 moves downwards to close the entrance of the jet pump flow path 214, the inner spring 268 may assist in the restoration of the shape of the foldable leaf spring 260 and the restoration of the position of the folding leaf spring portion 266.

When the plunger 230 moves downwards to a position in which the entrance of the jet pump flow path 214 is closed, the folding leaf spring portion 266 may return toward the first sidewall portion 220*a* of the second valve housing 220 due to the elasticity thereof while restoring the flange 266*a* into the open hole 224. Due to the assistance of the inner spring 268, the folding leaf spring portion 266 may more easily return toward the first sidewall portion 220*a* while restoring the flange 266*a* into the open hole 224.

Here, operating states of the fuel system of a vehicle pump valve having the above-described configuration will be described hereinafter with reference to FIGS. 5 to 7.

Figure 5:
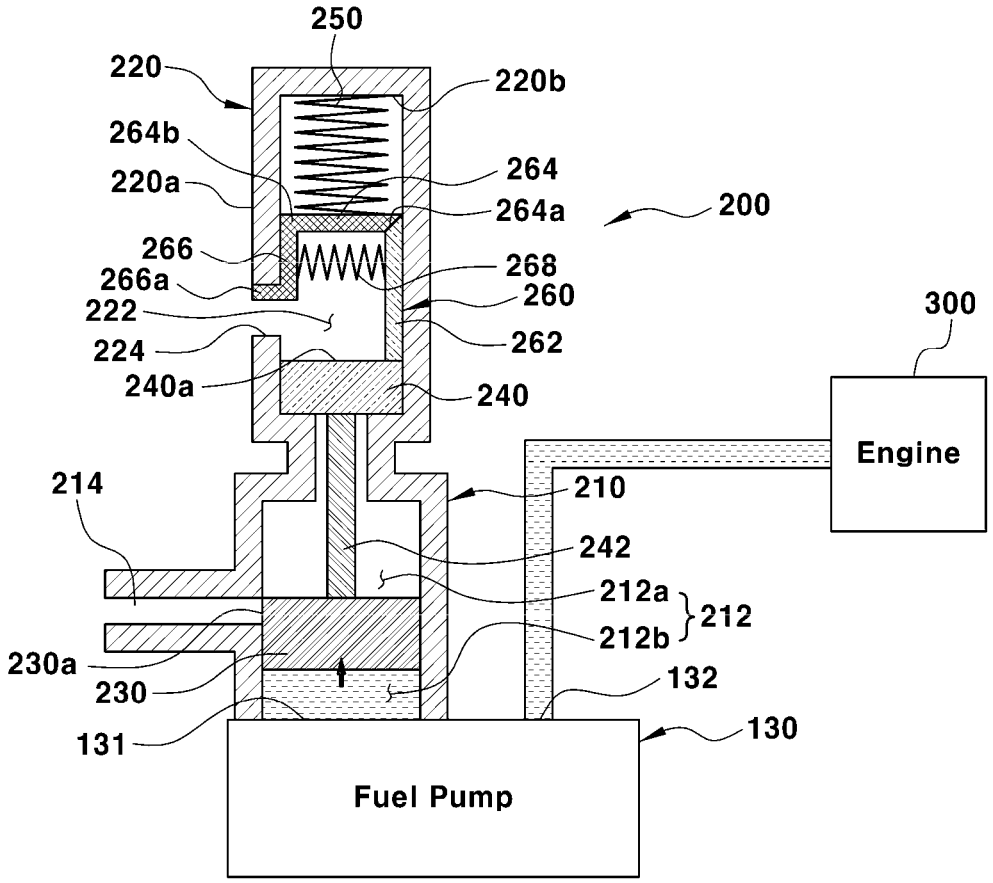
FIGS. 5 to 7 illustrate operating states of the jet pump control valve according to an embodiment of the present disclosure.
Figure 6:
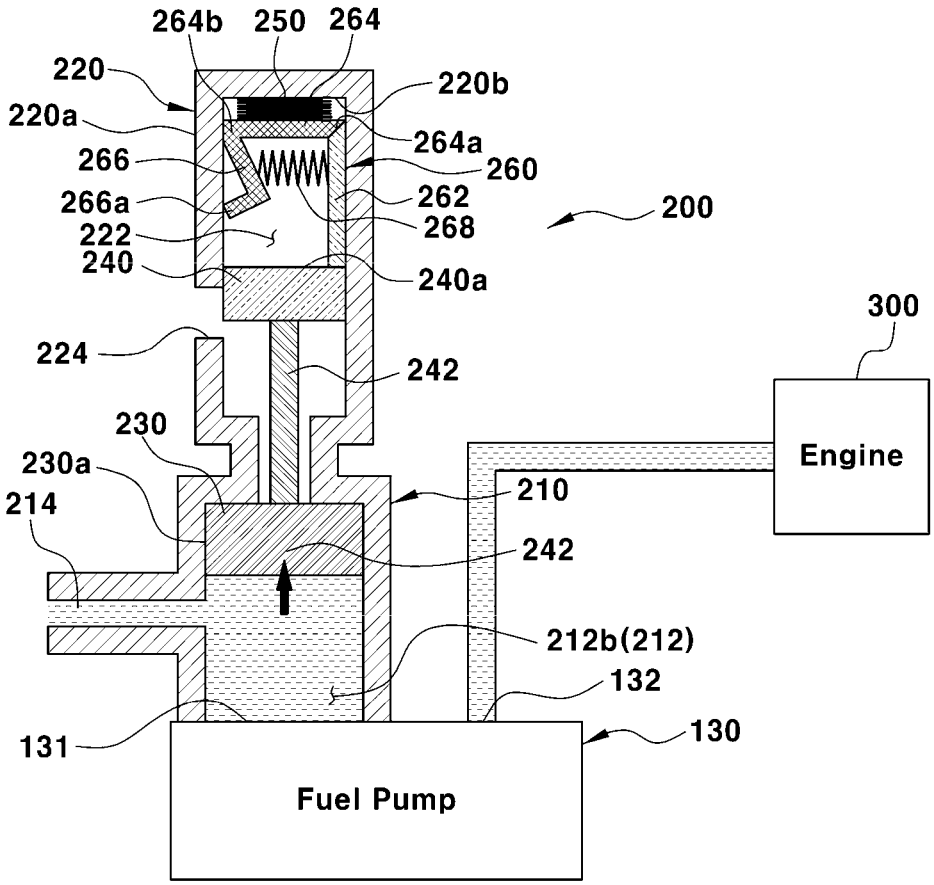
Figure 7:
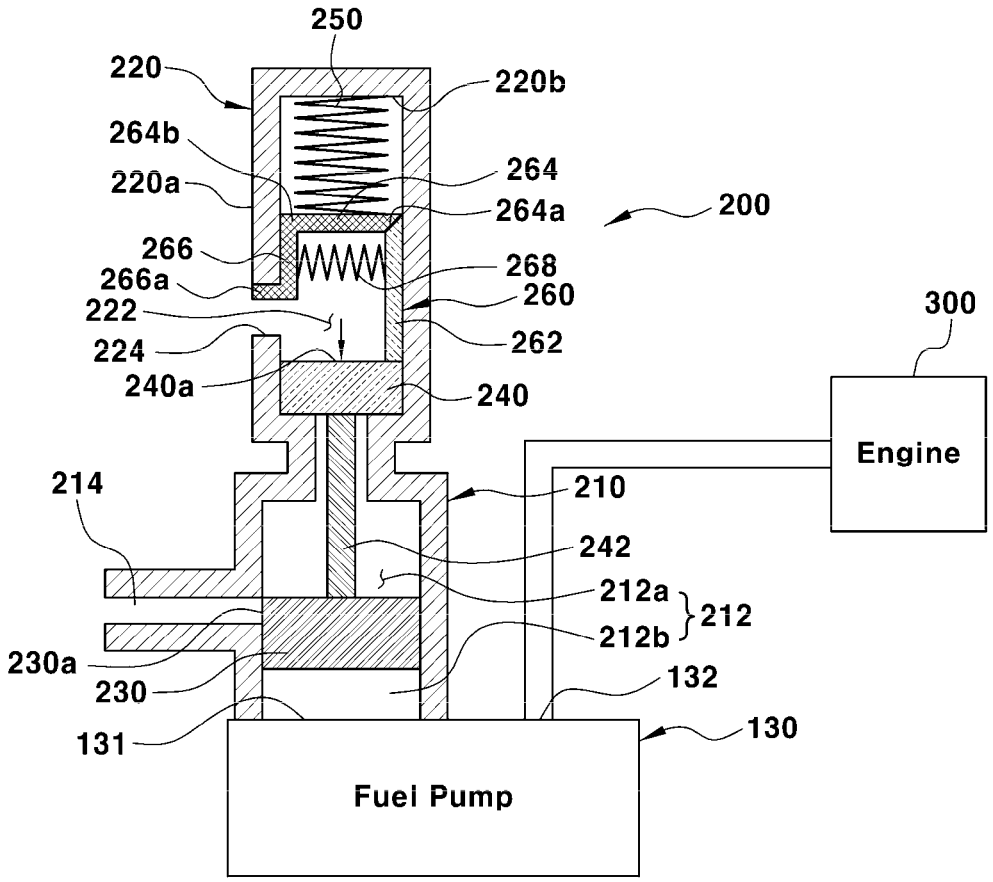

FIGS. 5 to 7 illustrate operating states of the jet pump control valve according to the present disclosure. FIG. 5 illustrates a valve operating state before the pressure of fuel supplied to the engine by the fuel pump in the start of the engine reaches the first set pressure, FIG. 6 illustrates a valve operating state after the pressure of fuel supplied to the engine by the fuel pump in the start of the engine has reached the first set pressure, and FIG. 7 illustrates a valve operating state when after the pressure of fuel supplied to the engine by the fuel pump in the stopping of the engine has reached the first set pressure.

As illustrated in FIG. 5, even in a case where the pressure of fuel discharged from the fuel pump 130 in the start of the engine is applied to the plunger 230, when the pressure of fuel applied to the plunger 230 is smaller than the first set pressure for opening the jet pump flow path 214, the plunger 230 maintains the jet pump flow path 214 in the closed position.

Accordingly, the supply of fuel to the jet pump 120 is prevented until the pressure of fuel supplied to the engine 300 reaches the first set pressure for appropriate start of the engine 300, and only a fuel line connecting the fuel pump 130 and the engine 300 is opened to supply fuel from the reservoir cup 110 to the engine 300. Consequently, a loss in the flow rate of fuel, flowing toward the jet pump 120, is prevented, thereby reducing a time in which the pressure of fuel increases during the start of the engine.

Afterwards, when the pressure of fuel discharged from the fuel pump 130 to the engine 300 is increased to reach the first set pressure, the pressure of fuel discharged from the fuel pump 130 to be applied to the plunger 230 also reaches the first set pressure.

As illustrated in FIG. 6, when the pressure of fuel applied to the plunger 230 is equal to or greater than the first set pressure, the flange 266*a* of the foldable leaf spring 260 is detached from the open hole 224 of the second valve housing 220, so that the plunger 230 moves upwards. With the plunger 230 moving upwards while compressing the elastic member 250, the jet pump flow path 214 is opened.

Figure 8:
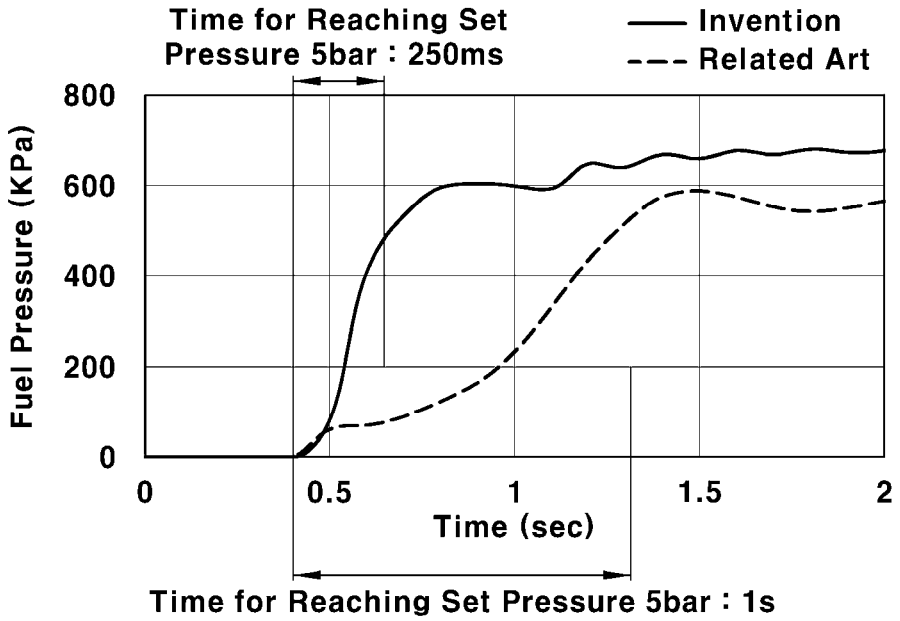
FIG. 8 is a graph illustrating a result of evaluating cold startability of the valve system of the present disclosure and cold startability of the valve system of the related art.

Referring to FIG. 8, comparing to a related-art case in which a time taken for the pressure of fuel supplied to the engine by the fuel pump to be increased to the first set pressure in a cold start of the engine is about 1 second, the disclosure may reduce the time to about 250 ms. Consequently, the engine may be rapidly and easily started even in the cold start, thereby improving cold startability of the engine.

In addition, after the jet pump flow path 214 is opened, when the pressure of fuel supplied to the jet pump 120 is greater than the second set pressure even though being smaller than the first set pressure, the compressed state of the elastic member 250 is maintained by the pressure of fuel exceeding the second set pressure (i.e. the pressure for compressive deformation of the elastic member), since the flange 266*a* of the foldable leaf spring 260 has already been released from the open hole 224. Consequently, the plunger 230 is continuously located in the upper lift path 212, so that the jet pump flow path 214 remains in the opened position.

In other words, after the jet pump flow path 214 is opened, when the pressure of fuel applied to the plunger 230 is greater than the second set pressure, the compressed state of the elastic member 250 is maintained, and thus, the opened positioned of the jet pump flow path 214 is maintained.

In addition, as the operation of the fuel pump 130 is stopped when the engine is stopped, the pressure of fuel applied to the plunger 230 is reduced to reach the second set pressure, the plunger 230 is moved downwards due to the restoring force of the elastic member 250 to close the jet pump flow path 214, as illustrated in FIG. 7.

Although the embodiments of the present disclosure have been described for illustrative purposes, those skilled in the art will appreciate that various modifications, improvements, additions, and substitutions are possible, without departing from the scope and spirit of the present disclosure as disclosed in the accompanying claims.

What is claimed is:

1. A valve system of a vehicle fuel pump, the valve system comprising:

a reservoir cup disposed within a fuel tank storing fuel in the reservoir cup;

a fuel pump configured to pump fuel from the reservoir cup to an engine while supplying fuel to a jet pump through a first discharge port of the fuel pump;

the jet pump configured to charge the reservoir cup with fuel by drawing fuel from the fuel tank by using a pressure of fuel supplied by the fuel pump; and a jet pump control valve disposed on the first discharge port and configured to control a flow of fuel discharged from the fuel pump to the jet pump, wherein, when the engine is on and a pressure of fuel discharged from the fuel pump to the engine is increased to reach a first set pressure, the jet pump control valve opens a jet pump flow path connecting the jet pump and the first discharge port of the fuel pump, and maintains the jet pump flow path in a closed state before reaching the first set pressure, and wherein, when the engine is off and the pressure of fuel discharged from the fuel pump to the jet pump is reduced to reach a second set pressure determined to be smaller than the first set pressure, the jet pump control valve closes the jet pump flow path, and maintains the open jet pump flow path when the pressure of fuel discharged from the fuel pump to the jet pump is at a pressure value between the first set pressure and the second set pressure, wherein the jet pump control valve comprises:

a first valve housing, in which a plunger lift path having a predetermined height is defined, wherein the jet pump flow path is configured to be connected to a middle position of the plunger lift path;

a plunger disposed on the plunger lift path in a liftable manner so as to open and close the jet pump flow path depending on a position on the plunger lift path;

a second valve housing, in which a piston lift path having a predetermined height is defined, having an open hole defined on a first sidewall portion of the second valve housing;

a piston disposed on the piston lift path in a liftable manner and configured to be integrally connected to the plunger via a lift bar;

an elastic member arranged between a bottom surface of a top end of the second valve housing and a top surface of the piston, the elastic member configured to be compressed when the plunger moves upwards; and a foldable leaf spring disposed on the top surface of the piston and arranged between the piston and the elastic member, and configured to restrain the jet pump flow path from being opened by a pressure of fuel smaller than the first set pressure when the engine is on.

2. The valve system according to claim 1, wherein the foldable leaf spring comprises:

a horizontal leaf spring portion disposed in the piston lift path to extend in a direction perpendicular to a direction in which the piston is configured to be lifted up and down, with the elastic member being disposed on a top surface of the horizontal leaf spring portion;

a vertical leaf spring portion configured to be attached to a first end of the horizontal leaf spring portion and disposed in the piston lift path in the direction in which the piston is lifted up and down, with a bottom end of the vertical leaf spring portion being fixedly disposed on the top surface of the piston; and a folding leaf spring portion configured to be integrally disposed on a second end portion of the horizontal leaf spring portion in a foldable manner and disposed in the piston lift path to extend in the direction in which the piston is lifted up and down, with a flange being integrally disposed on a bottom end of the folding leaf spring portion to extend through and held by the open hole.

3. The valve system according to claim 2, wherein, when the folding leaf spring portion pivots toward a bottom surface of the vertical leaf spring portion about a second end portion of the horizontal leaf spring portion due to a pressure of fuel applied to the plunger by the fuel pump, the plunger is released and detached from the open hole and is configured to move upwards in the plunger lift path in a direction of opening the jet pump flow path.

4. The valve system according to claim 2, wherein the foldable leaf spring further comprises an inner spring arranged between the vertical leaf spring portion and the folding leaf spring portion, the inner spring being configured to be compressed when the folding leaf spring portion pivots toward the bottom surface of the vertical leaf spring portion.

5. The valve system according to claim 3, wherein the first set pressure is a value obtained by adding a pressure of fuel for compressive deformation of the elastic member and a pressure of fuel for folding deformation of the foldable leaf spring.

6. The valve system according to claim 2, wherein the plunger lift path comprises:

an upper lift path in which the plunger is located to open the jet pump flow path; and a lower lift path in which the plunger is located to close the jet pump flow path.

7. The valve system according to claim 6, wherein, when the pressure of fuel discharged to the jet pump at start of the engine is equal to or greater than the first set pressure, the jet pump control valve causes the flange of the foldable leaf spring to be detached and released from the open hole and the plunger to be located in the upper lift path so that the jet pump flow path is opened.

8. The valve system according to claim 6, wherein, when the pressure of fuel discharged to the jet pump at start of the engine is smaller than the first set pressure, the jet pump control valve causes the flange of the foldable leaf spring to be located in and held by the open hole and the plunger to be located in the lower lift path so that the jet pump flow path remains in a closed position.

9. The valve system according to claim 6, wherein, when the pressure of fuel discharged to the jet pump is reduced to be smaller than the first set pressure and is greater than the second set pressure after the jet pump path is opened, the jet pump control valve causes the flange of the foldable leaf spring to remain released from the open hole and the plunger to remain in the upper lift path so that the jet pump flow path remains in an opened position.

* * * * *